US010077587B2

(12) United States Patent
Batchelor et al.

(10) Patent No.: US 10,077,587 B2
(45) Date of Patent: Sep. 18, 2018

(54) BREAKAWAY GATE ASSEMBLY, AND RELATED COMPONENTS, SYSTEMS, AND METHODS

(71) Applicant: Seegars Fence Company of Goldsboro, Inc., Goldsboro, NC (US)

(72) Inventors: Robert Dean Batchelor, Goldsboro, NC (US); Benjamin Weston Seegars, Goldsboro, NC (US)

(73) Assignee: SEEGARS FENCE COMPANY OF GOLDSBORO, INC., Goldsboro, NC (US)

( * ) Notice: Subject to any disclaimer, the term of this patent is extended or adjusted under 35 U.S.C. 154(b) by 193 days.

(21) Appl. No.: 15/260,838

(22) Filed: Sep. 9, 2016

(65) Prior Publication Data

US 2017/0074015 A1 Mar. 16, 2017

Related U.S. Application Data

(60) Provisional application No. 62/217,458, filed on Sep. 11, 2015.

(51) Int. Cl.

| | |
|---|---|
| ***E05C 21/02*** | (2006.01) |
| ***E05D 7/12*** | (2006.01) |
| ***E06B 11/04*** | (2006.01) |

(52) U.S. Cl.

CPC ..... *E05D 7/12* (2013.01); *E06B 11/04* (2013.01); *E05D 2007/126* (2013.01); *E05Y 2900/40* (2013.01); *E05Y 2900/402* (2013.01)

(58) Field of Classification Search

CPC ..... E05D 7/12; E05D 7/009; E05D 7/0407; E05D 7/043; E05D 11/00; E05D 7/00; E05D 2007/126; E05D 7/125; E06B 11/04; E06B 2009/002; E06B 11/0022; E06B 3/36; E06B 9/04; E05Y 2900/402; E05Y 2900/40; E05F 15/53

USPC ... 49/463, 304, 303, 333, 386, 465, 169, 70, 49/383, 384; 256/67, 65.04, 65.14, 65.16, 256/73; 109/67, 595; 119/524

See application file for complete search history.

(56) References Cited

U.S. PATENT DOCUMENTS 188,402 A 3/1877 Palm
749,015 A 1/1904 Bailey
(Continued)

*Primary Examiner* — Chi Q Nguyen
(74) *Attorney, Agent, or Firm* — Withrow & Terranova, PLLC

(57) ABSTRACT

A breakaway gate assembly includes a hinge subassembly rotatably mounted to a vertical hinge post, and a gate subassembly removably mounted to the hinge subassembly. The gate subassembly includes a gate body and a plurality of standoff features coupled thereto. The hinge subassembly comprises a vertical mounting plate forming a plurality of apertures configured to receive and secure a respective plurality of standoff features. Each of the plurality of apertures comprises a wide portion for receiving a head portion of one of the standoff features, and a narrow portion below the wide portion for receiving a stem portion of a respective standoff feature to position a portion of the vertical mounting plate between the vertical mounting surface and the respective bearing surface. The hinge subassembly also comprises a plurality of hinge rings coupled to the first plate surface, the plurality of hinge rings rotatably disposed around the vertical hinge post.

12 Claims, 12 Drawing Sheets

(56) References Cited

U.S. PATENT DOCUMENTS

| | | | | |
|---|---|---|---|---|
| 1,835,042 | A | 12/1931 | Hammer | |
| 2,074,759 | A * | 3/1937 | Richards | E05B 65/0007 292/213 |
| 3,332,182 | A * | 7/1967 | Mark | E04B 2/7453 256/24 |
| 5,044,588 | A | 9/1991 | Gunter | |
| 5,103,658 | A * | 4/1992 | McQuade | E05B 65/0007 49/394 |
| 5,593,141 | A * | 1/1997 | Cain | A01K 1/0017 256/26 |
| 5,624,170 | A | 4/1997 | Hasty | |
| 7,155,779 | B2 * | 1/2007 | Watkins | E05F 15/54 16/316 |
| 7,461,489 | B2 * | 12/2008 | Herbertsson | E04H 17/165 256/22 |
| 7,887,029 | B2 | 2/2011 | Flannery | |
| 9,371,642 | B2 * | 6/2016 | Herbertsson | E04B 1/38 |
| 9,458,645 | B1 * | 10/2016 | King | E04H 17/14 |
| 9,777,520 | B2 * | 10/2017 | Volin | E05D 5/06 |
| 2003/0009945 | A1 * | 1/2003 | Cheng | E05F 1/063 49/57 |
| 2005/0028947 | A1 * | 2/2005 | Waldman | E05B 17/2053 160/215 |
| 2012/0261632 | A1 | 10/2012 | Bertucat | |
| 2013/0086840 | A1 * | 4/2013 | Marsden | E05B 41/00 49/13 |
| 2015/0191955 | A1 * | 7/2015 | Dudley | E05F 3/08 49/333 |

* cited by examiner

BREAKAWAY GATE ASSEMBLY, AND RELATED COMPONENTS, SYSTEMS, AND METHODS

RELATED APPLICATIONS

This application claims priority to provisional patent application Ser. No. 62/217,458, filed Sep. 11, 2015, the disclosure of which is hereby incorporated herein by reference in its entirety.

FIELD OF THE DISCLOSURE

The disclosure relates generally to an assembly for a gate system, and more particularly to a breakaway gate assembly, and related components, devices, and methods.

BACKGROUND

Many types of gate systems, particularly larger scale commercial and industrial gate systems, need to be extremely durable and endure the harshest weather elements. Many of these gate systems must also require minimal maintenance and be able to withstand frequent interaction with heavy equipment and/or vehicles operating in close proximity with the gate system. For example, a conventional gate system may be used to securely gate off an exterior structure, such as a commercial dumpster or similar installation. One common solution is an all-welded gate and hinge system.

One drawback of this type of all-welded gate and hinge system, however, is that whenever any component, including a gate post, hinge, and/or the gate itself becomes damaged, the damage sustained to this system is very costly to repair and disrupts normal use by the customer. This type of damage can also be very difficult to avoid in many applications. For example, in the commercial dumpster installation above, a commercial-grade garbage truck, which lifts and empties commercial dumpsters, will routinely be operating adjacent the gate system. As a result, it is common for the vehicle to accidentally damage the gate system, for example, by colliding with a portion of the gate. Thus, there is a need for a strong and durable gate system that is less expensive to repair in the event of damage.

SUMMARY

The disclosure relates generally to an assembly for a gate system, and more particularly to a breakaway gate assembly, and related components, devices, and methods. In one embodiment, a breakaway gate assembly includes a hinge subassembly rotatably mounted to a vertical hinge post, and a gate subassembly removably mounted to the hinge subassembly. The gate subassembly comprises a gate body and a plurality of standoff features coupled thereto. Each standoff feature comprises a stem portion extending horizontally away from a vertical mounting surface of the gate body, and a head portion coupled to a distal end of the stem portion, the head portion having a bearing surface facing the vertical mounting surface. The hinge subassembly comprises a vertical mounting plate including a first plate surface and a second plate surface opposite the first plate surface, the vertical mounting plate forming a plurality of apertures configured to receive and secure the respective plurality of standoff features. Each of the plurality of apertures comprises a wide portion for receiving the head portion of one of the standoff features, and a narrow portion, below the wide portion, for receiving the stem portion of the respective standoff feature to position a portion of the vertical mounting plate between the vertical mounting surface and the respective bearing surface. The hinge subassembly also comprises a plurality of hinge rings coupled to the first plate surface, the plurality of hinge rings rotatably disposed around the vertical hinge post, the plurality of hinge rings having an internal diameter larger than the first diameter.

One advantage of this arrangement is that a force sufficient to damage the gate body, such as a vehicle collision with the gate, for example, may cause the standoff features to fail before the force is transmitted to the vertical hinge post. In many applications, the cost to repair or replace a vertical hinge post is very high because the hinge post may be permanently installed in a concrete foundation, while the cost to replace or repair the gate subassembly and/or hinge subassembly is significantly lower. By causing the gate subassembly to break away from the hinge subassembly, damage to the vertical hinge post may be prevented, thereby mitigating the total repair and replacement cost.

According to one embodiment, a breakaway gate assembly is disclosed. The breakaway gate assembly comprises a vertical hinge post having a first diameter. The breakaway gate assembly further comprises a gate subassembly. The gate subassembly comprises a gate body comprising a vertical mounting surface. The gate subassembly further comprises a plurality of standoff features coupled to the gate body. Each of the plurality of standoff features comprises a stem portion extending horizontally away from a vertical mounting surface, the stem portion having a first horizontal width. Each of the plurality of standoff features further comprises a head portion coupled to a distal end of the stem portion, the head portion having a second horizontal width greater than the first horizontal width, the head portion having a bearing surface facing the vertical mounting surface. The breakaway gate assembly further comprises a hinge subassembly configured to support the gate subassembly. The hinge subassembly comprises a vertical mounting plate comprising a first plate surface and a second plate surface opposite the first plate surface. The vertical mounting plate forms a plurality of apertures configured to receive and secure the respective plurality of standoff features. Each of the plurality of apertures comprises a wide portion having a third horizontal width larger than the first horizontal width. Each of the plurality of apertures further comprises a narrow portion having a fourth horizontal width smaller than the third horizontal width and equal to or greater than the second horizontal width, the narrow portion configured to receive and retain the respective stem portion to position a portion of the vertical mounting plate between the vertical mounting surface and the respective bearing surface. The hinge subassembly further comprises a plurality of hinge rings coupled to the first plate surface, the plurality of hinge rings rotatably disposed around the vertical hinge post, the plurality of hinge rings having an internal diameter larger than the first diameter.

According to another embodiment, a breakaway hinge subassembly for a gate assembly is disclosed. The breakaway hinge subassembly comprises a vertical mounting plate comprising a first plate surface and a second plate surface opposite the first plate surface. The vertical mounting plate forms a plurality of apertures configured to receive and secure a respective plurality of standoff features extending from a vertical mounting surface of a gate body. Each of the plurality of apertures comprises a wide portion wider than a head portion of a respective standoff feature. Each of the plurality of apertures further comprises a narrow portion narrower than the head portion and wider than a stem portion of the respective standoff feature, the narrow portion configured to retain the head portion of the respective standoff feature on the first plate surface and the vertical mounting surface of the gate body on the second plate surface. The hinge subassembly further comprises a plurality of hinge rings coupled to the first plate surface, the plurality of hinge rings configured to be rotatably disposed around a vertical hinge post.

According to another embodiment, a method of mounting a breakaway gate assembly is disclosed. The method comprises disposing a plurality of hinge rings around a vertical hinge post, the plurality of hinge rings coupled to a vertical mounting plate, wherein the vertical mounting plate is rotatable with respect to the vertical hinge post. The method further comprises inserting a plurality of standoff features extending from a gate body of a gate subassembly through a respective plurality of wide portions of a plurality of apertures in the vertical hinge post to contact a vertical mounting surface of the gate body with a first plate surface of the vertical mounting plate. The method further comprises moving the gate body downwardly with respect to the vertical mounting plate to move the plurality of standoff features downwardly from the wide portions of the plurality of apertures into respective narrow portions of the plurality of apertures.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiments, and together with the description serve to explain principles and operation of the various embodiments.

DETAILED DESCRIPTION

Figure 1A:
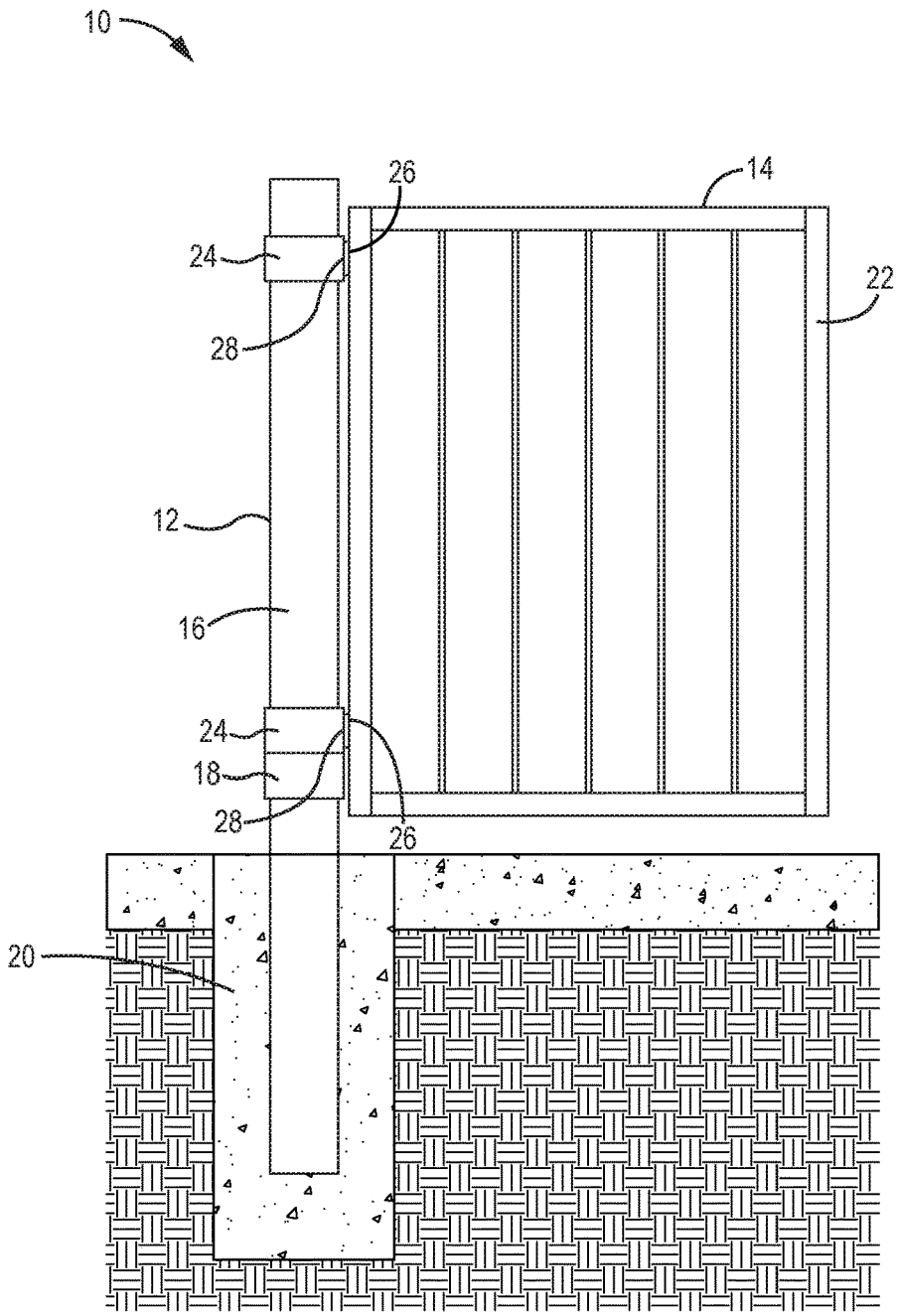
FIG. 1A PRIOR ART
FIG. 1A is a diagram of a conventional unitary gate assembly according to the prior art.

The embodiments set forth below represent the information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first plate surface" and "second plate surface," and does not imply a priority, a type, an importance, or other attribute, unless otherwise stated herein. The term "substantially" used herein in conjunction with a numeric value means any value that is within a range of five percent greater than or five percent less than the numeric value.

As used herein and in the claims, the articles "a" and "an" in reference to an element refers to "one or more" of the element unless otherwise explicitly specified. Various embodiments will be further clarified by the following examples.

The disclosure relates generally to an assembly for a gate system, and more particularly to a breakaway gate assembly, and related components, devices, and methods. In one embodiment, a breakaway gate assembly includes a hinge subassembly rotatably mounted to a vertical hinge post, and a gate subassembly removably mounted to the hinge subassembly. The gate subassembly comprises a gate body and a plurality of standoff features coupled thereto. Each standoff feature comprises a stem portion extending horizontally away from a vertical mounting surface of the gate body, and a head portion coupled to a distal end of the stem portion, the head portion having a bearing surface facing the vertical mounting surface. The hinge subassembly comprises a vertical mounting plate including a first plate surface and a second plate surface opposite the first plate surface, the vertical mounting plate forming a plurality of apertures configured to receive and secure the respective plurality of standoff features. Each of the plurality of apertures comprises a wide portion for receiving the head portion of one of the standoff features, and a narrow portion below the wide portion for receiving the stem portion of the respective standoff feature to position a portion of the vertical mounting plate between the vertical mounting surface and the respective bearing surface. The hinge subassembly also comprises a plurality of hinge rings coupled to the first plate surface, the plurality of hinge rings rotatably disposed around the vertical hinge post, the plurality of hinge rings having an internal diameter larger than the first diameter.

One advantage of this arrangement is that a force sufficient to damage the gate body, such as a vehicle collision with the gate, for example, may cause the standoff features to fail before the force is transmitted to the vertical hinge post. In many applications, the cost to repair or replace a vertical hinge post is very high because the hinge post may be permanently installed in a concrete foundation, while the cost to replace or repair the gate subassembly and/or hinge subassembly is significantly lower. By causing the gate subassembly to break away from the hinge subassembly, damage to the vertical hinge post may be prevented, thereby mitigating the total repair and replacement cost.

Before discussing the features of the breakaway gate system disclosed herein, a discussion of a conventional unitary gate system will be discussed. In this regard, FIG. 1A is a diagram of a conventional unitary gate assembly 10 according to the prior art. A vertical hinge post 12 has a unitary gate subassembly 14 rotatably mounted thereon. The vertical hinge post 12 includes a substantially cylindrical rigid post body 16, which in many applications may be a steel pipe filled with concrete, and a hinge support ring 18 coupled to the cylindrical rigid post body 16, by welding for example. In this example, the post body 16 is permanently fixed within a concrete foundation 20, which may be saw cut to 36"×36," for example, or another suitable footprint, and the post body 16 extends a distance above the concrete foundation 20, for example, between 6 and 8 feet.

The unitary gate subassembly 14 includes a gate body 22 and two or more hinge rings 24 coupled to a vertical surface 26 of the gate body 22. In this example, each hinge rings 24 is welded to a standoff member 28, which is welded to the vertical surface 26. In other conventional examples, the hinge rings 24 may be welded directly to the vertical surface 26, or otherwise rigidly and permanently attached to the gate body 22. The unitary gate subassembly 14 can be rotatably coupled to the vertical hinge post 12 in one of two ways. One option is to install the hinge rings 24 over the vertical hinge post 12 prior to coupling the hinge rings 24 to the gate body 22, and welding the rings to the gate body 22 on site. This is labor intensive, however, and it may be difficult to keep the heavy gate body 22 plumb during installation. Another option is to pre-install the hinge rings 24 on the gate body 22 and lift the entire unitary gate subassembly 14 vertically and to lower the hinge rings 24 around the vertical hinge post 12. This requires additional machinery to lift and position the heavy unitary gate subassembly 14, however, and increases the risk of accident and injury. Thus, there is a need for a gate assembly that is safe and inexpensive to install.

Figure 1B:
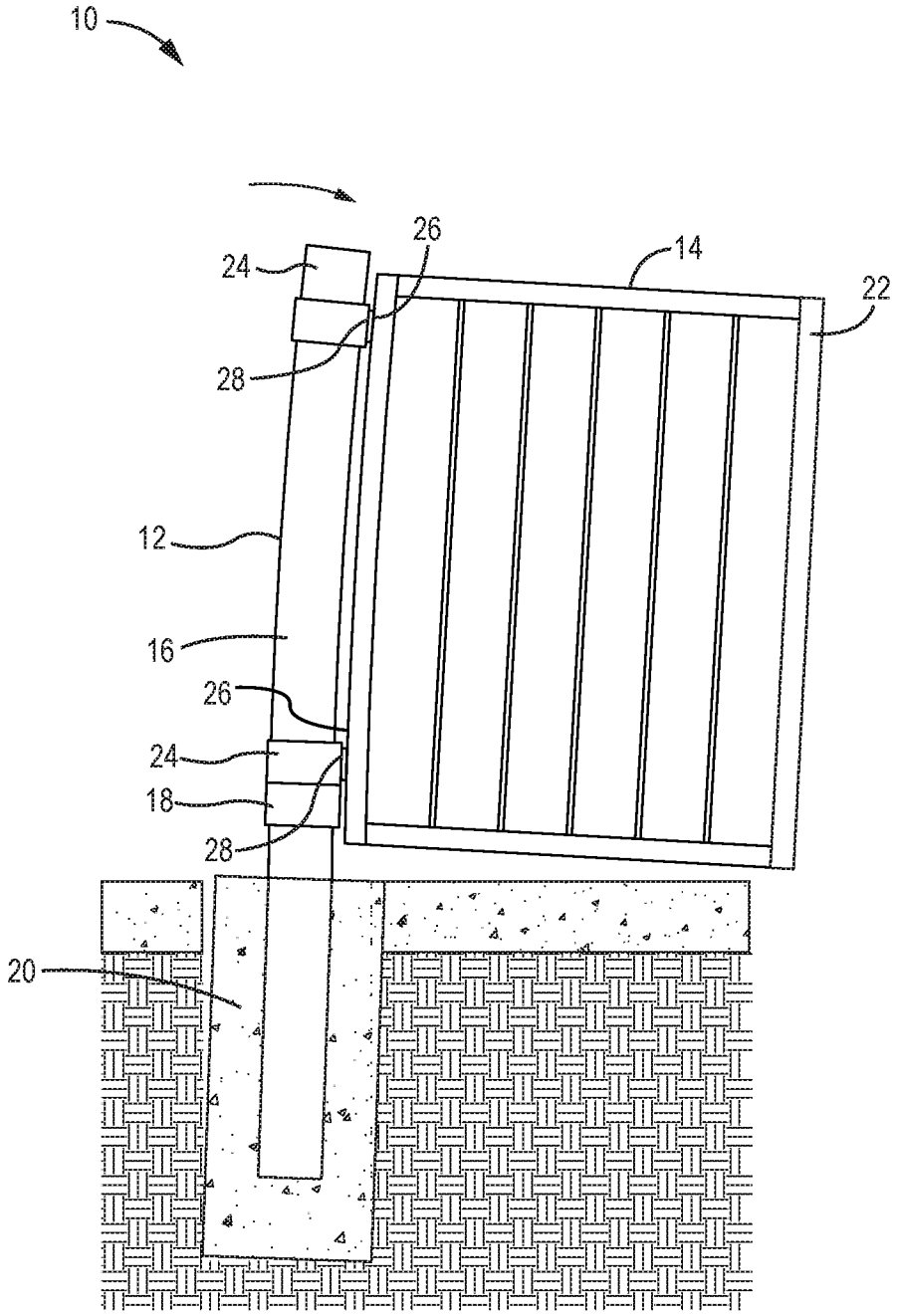
FIG. 1B PRIOR ART
FIG. 1B is a diagram of the conventional unitary gate and hinge system of FIG. 1A in a failure condition.

Another drawback for the conventional unitary gate assembly 10 of FIG. 1A is that it is difficult to avoid damaging the vertical hinge post 12 when the conventional unitary gate assembly 10 is involved in an accident or collision. For example, this type of conventional unitary gate assembly 10 is commonly used in larger scale industrial and commercial applications, such as to securely gate off an exterior structure, such as a commercial dumpster or similar installation. These applications often involve heavy vehicles and/or machinery operating in close proximity to the conventional unitary gate assembly 10, such as, for example, a commercial-grade garbage truck, which lifts and empties commercial dumpsters. When heavy vehicles cause damage to the conventional unitary gate assembly 10, for example, by accidentally colliding with the gate body 22, a large portion of the force of the collision may be transferred to the vertical hinge post 12. As shown by FIG. 1B, which illustrates the conventional unitary gate assembly 10 in a failure condition, a collision with the gate body 22 can cause the vertical hinge post 12 to bend.

The permanent installation of the vertical hinge post 12 in the concrete foundation 20 is generally advantageous for providing structural support for the vertical hinge post 12 and allows the vertical hinge post 12 to support very heavy cantilevered loads, such as the unitary gate subassembly 14. If the vertical hinge post 12 is bent or otherwise damaged, however, the vertical hinge post 12 must often be replaced entirely. This is expensive and time consuming, typically requiring excavation and re-pouring of the concrete foundation 20. For example, in many applications, when the conventional unitary gate assembly 10 is damaged, the owner must hire a contractor to come on site and cut the hinge rings 24 away from the gate body 22, make repairs to the gate body 22, and fabricate new hinge rings 24. The contractor must then return to the site with a welder and weld the hinge rings 24 back to the gate body 22 in the field. This is a very labor intensive and, in many cases, dangerous task. Additionally, if the gate body 22 was originally painted or powder coated black (or any other color) as many typically are, field welding the unitary gate subassembly 14 necessarily compromises the painted or powder coated finish, requiring the paint or powder coating to be reapplied. Thus, there is a need for a gate assembly that is less expensive and time consuming to repair.

Figure 2A:
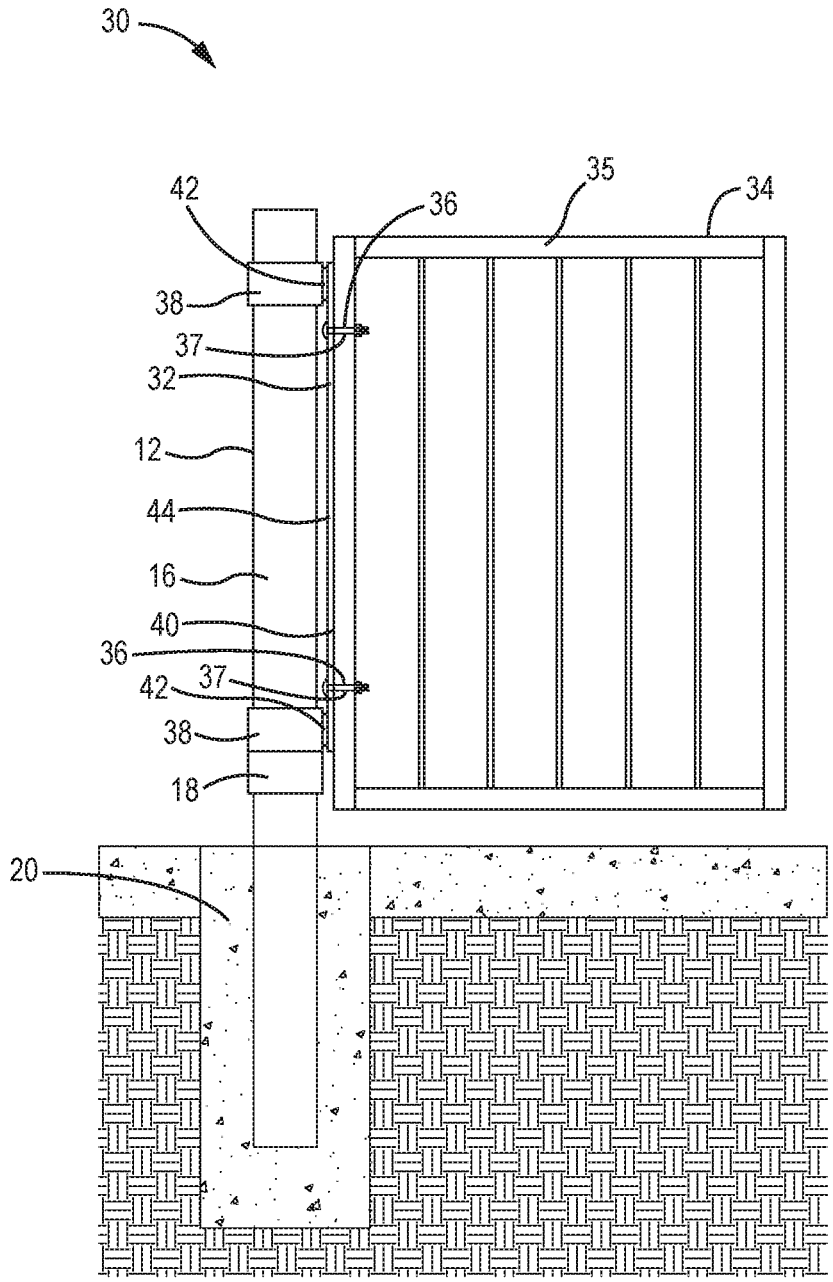
FIG. 2A is a diagram of a breakaway gate system having standoff features for removably mounting a gate subassembly to a hinge subassembly.

In this regard, according to one embodiment of the disclosure, FIG. 2A illustrates a breakaway gate assembly 30 having a hinge subassembly 32 rotatably mounted to a vertical hinge post 12 permanently installed in a concrete foundation 20. In this embodiment, a gate subassembly 34 is removably mounted to the hinge subassembly 32. The gate subassembly 34 includes a gate body 35 and a plurality of breakaway features 36 extending therefrom. In this example, each breakaway feature 36 passes through a gate aperture 37, such as a bolt hole for example, and is securely coupled to the gate body 35. The hinge subassembly comprises a plurality of hinge rings 38 rigidly coupled to a vertical mounting plate 40. In this example, a standoff member 42 is welded between each hinge ring 38 and the vertical mounting plate 40, but in other embodiments, the hinge rings 38 may be welded directly to the vertical mounting plate 40. The breakaway features 36 secure the gate subassembly 34 against a vertical mounting surface 44 of the hinge subassembly 32, thereby allowing the gate subassembly 34 to be supported by and rotate about the vertical hinge post 12.

Figure 2B:
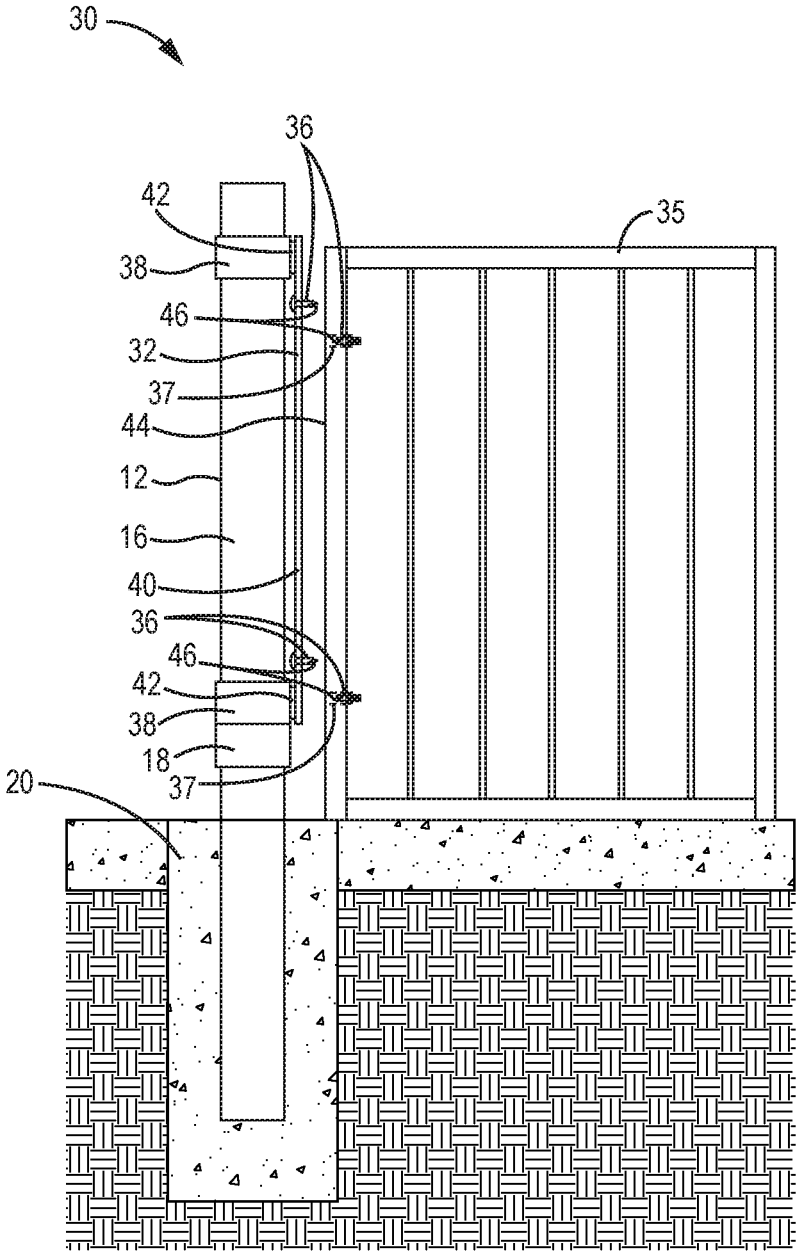
FIG. 2B is a diagram of the breakaway gate system of FIG. 2B in a failure condition, in which the standoff features break to allow the gate subassembly to separate from the hinge subassembly.

In this embodiment, the breakaway features 36 have sufficient strength to securely couple the gate subassembly 34 to the hinge subassembly 32 against the force of gravity and during normal operation, i.e., rotating the gate subassembly 34 about the vertical hinge post 12 to open or close the breakaway gate assembly 30. In this embodiment, however, if the gate subassembly 34 is subjected to a force beyond a certain threshold, e.g., a force significantly larger than the force of gravity, such as from a collision with a vehicle or heavy equipment, the breakaway features 36 are configured to fail before this larger force is transferred to the vertical hinge post 12. In this regard, FIG. 2B illustrates the breakaway gate assembly 30 of FIG. 2A in a failure condition. In this example, each of the breakaway features 36 comprises a weakened portion 46 configured to break when subjected to a force beyond a certain threshold. In this manner, the breakaway features 36 can be designed to withstand the forces associated with normal operation of the breakaway gate assembly 30, i.e., gravitational force and normal rotation of the breakaway gate assembly 30, and also to break at the weakened portion 46 when subjected to a significantly larger force. In this embodiment, the force required to break the weakened portions 46 of the breakaway features 36 may be significantly lower than a force required to bend, deform, or otherwise displace the vertical hinge post 12.

As discussed above, one advantage of this arrangement is that, in many applications, the cost to repair or replace the hinge subassembly 32 and/or gate subassembly 34 is significantly lower than the cost to repair the vertical hinge post 12. In this manner, by causing the gate subassembly 34 to break away from the hinge subassembly 32, damage to the vertical hinge post 12 may be prevented, thereby mitigating the total repair and replacement cost of the breakaway gate assembly 30 components.

Figure 3:
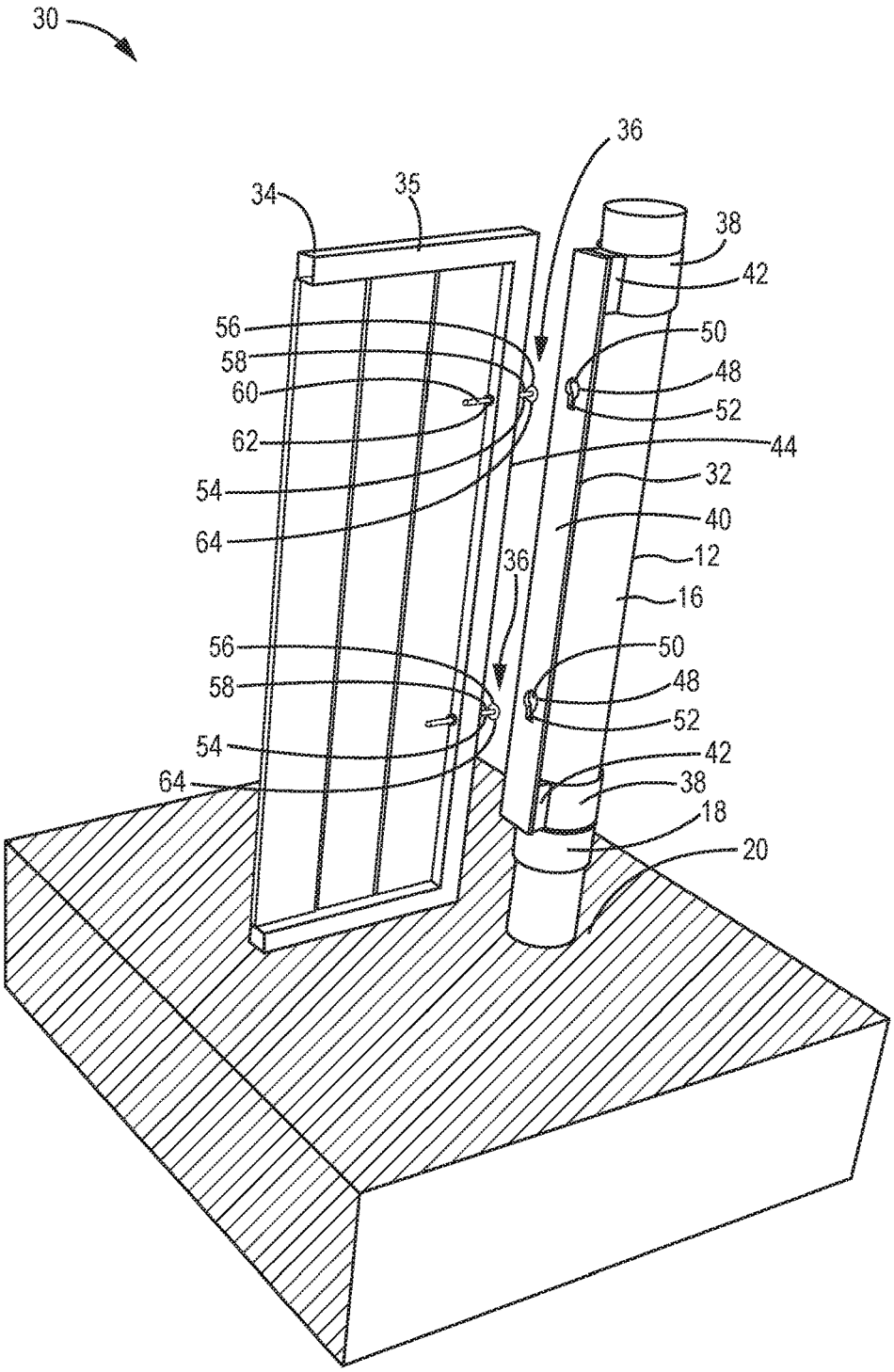
FIG. 3 is a perspective view of a portion of the breakaway gate system of FIG. 2A in a partially disassembled configuration.

Referring now to FIG. 3, a perspective view of a portion of the breakaway gate assembly 30 is illustrated, showing details of the hinge sub-assembly 32 and the breakaway features 36 of the gate subassembly 34. Each of the breakaway features 36 is configured to be removably inserted into a respective keyed aperture 48 of the hinge sub-assembly 32. Each keyed aperture 48 has a wide portion 50 configured to receive a respective breakaway feature 36 therethrough, and a narrow portion 52 below the wide portion 50 configured to receive the breakaway feature 36 after being inserted through the wide portion 50. The breakaway features 36 in this embodiment include standoff members 54 each comprising a head portion 56 disposed at a distal end of a narrower stem portion 58 extending horizontally away from a vertical mounting surface 44 of the gate body 35. In this embodiment, the standoff member may be formed by a bolt 60 secured to the gate body 35 by one or more nuts 62, but it should be understood that other types of standoff members 54 may be used as breakaway features 36, such as, for example, a screw or a permanently welded member. In this embodiment, the head portion 56 has a bearing surface 64 facing the vertical mounting surface 44 of the gate body 35. When the head portion 56 of the standoff member 54 is inserted through the wide portion 50 of the keyed aperture 48 and the stem portion 58 of the standoff member 54 is lowered into the narrow portion 52 of the keyed aperture 48, a portion of the vertical mounting plate 40 of the hinge subassembly 32 is positioned between the vertical mounting surface 44 of the gate body 35 and the bearing surface 64 of the head portion 56 of the respective standoff member 54.

Figure 4A:
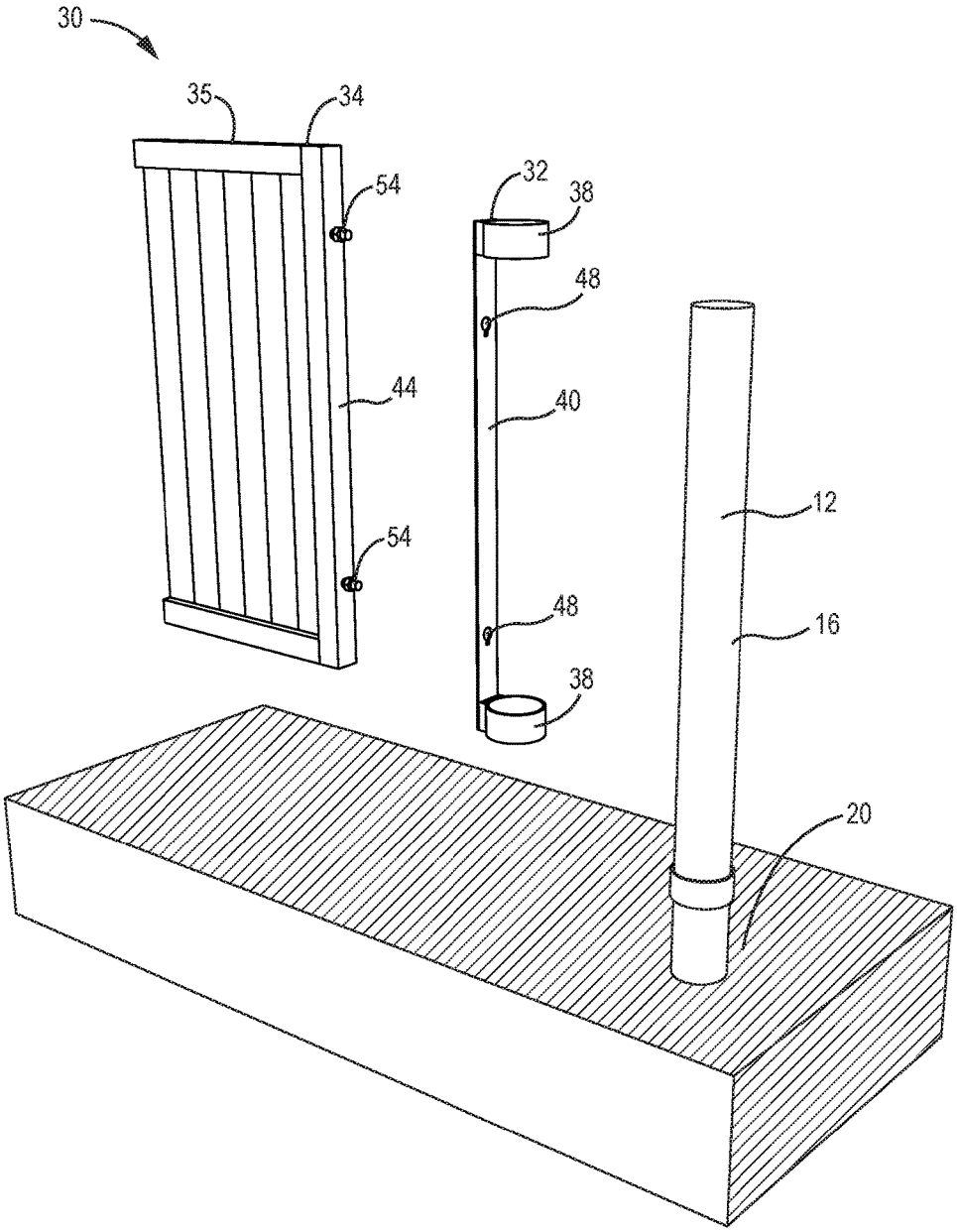
FIGS. 4A-4C illustrate a method of installing the breakaway gate system of FIGS. 2A-3 according to an embodiment.
Figure 4B:
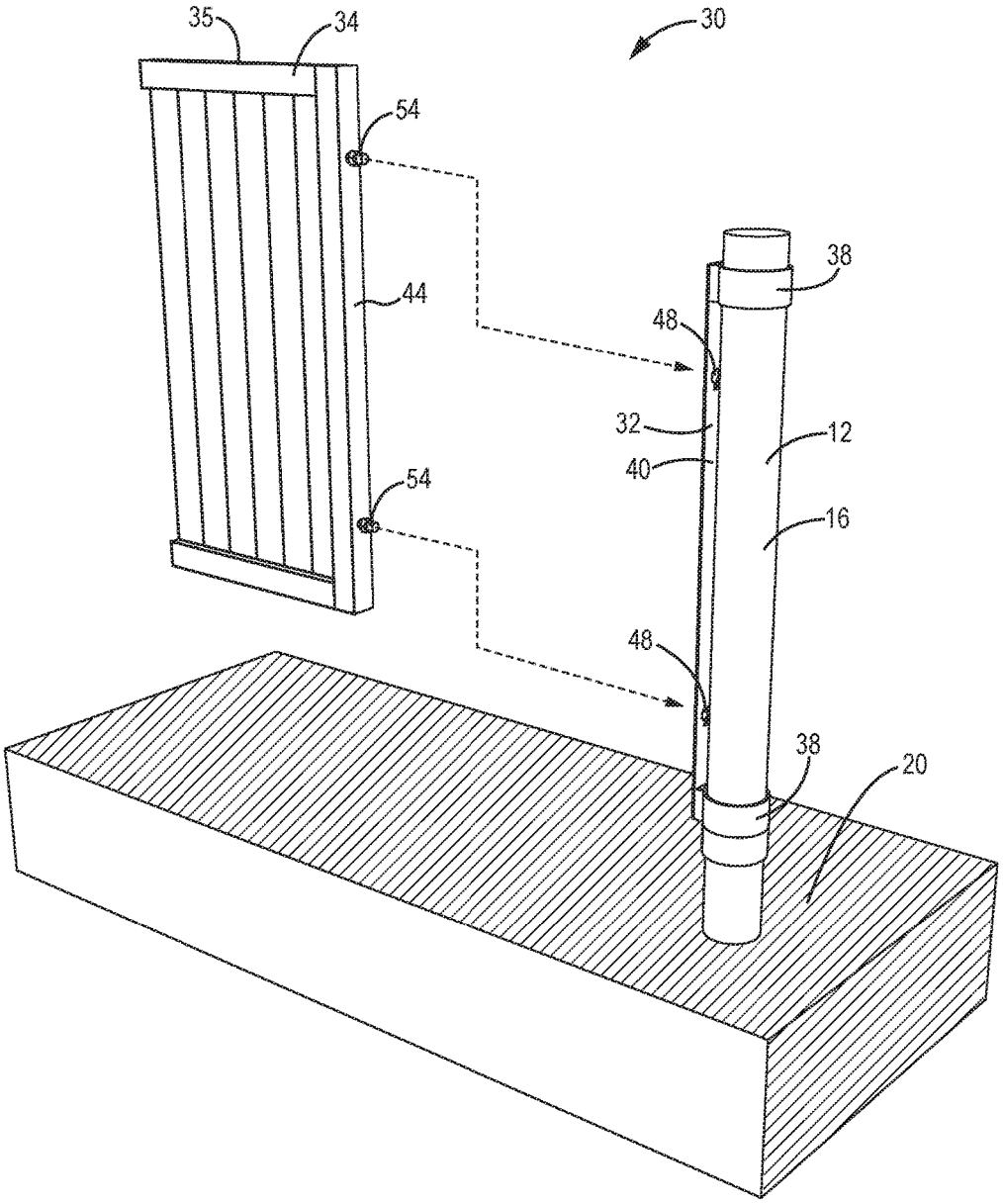
Figure 4C:
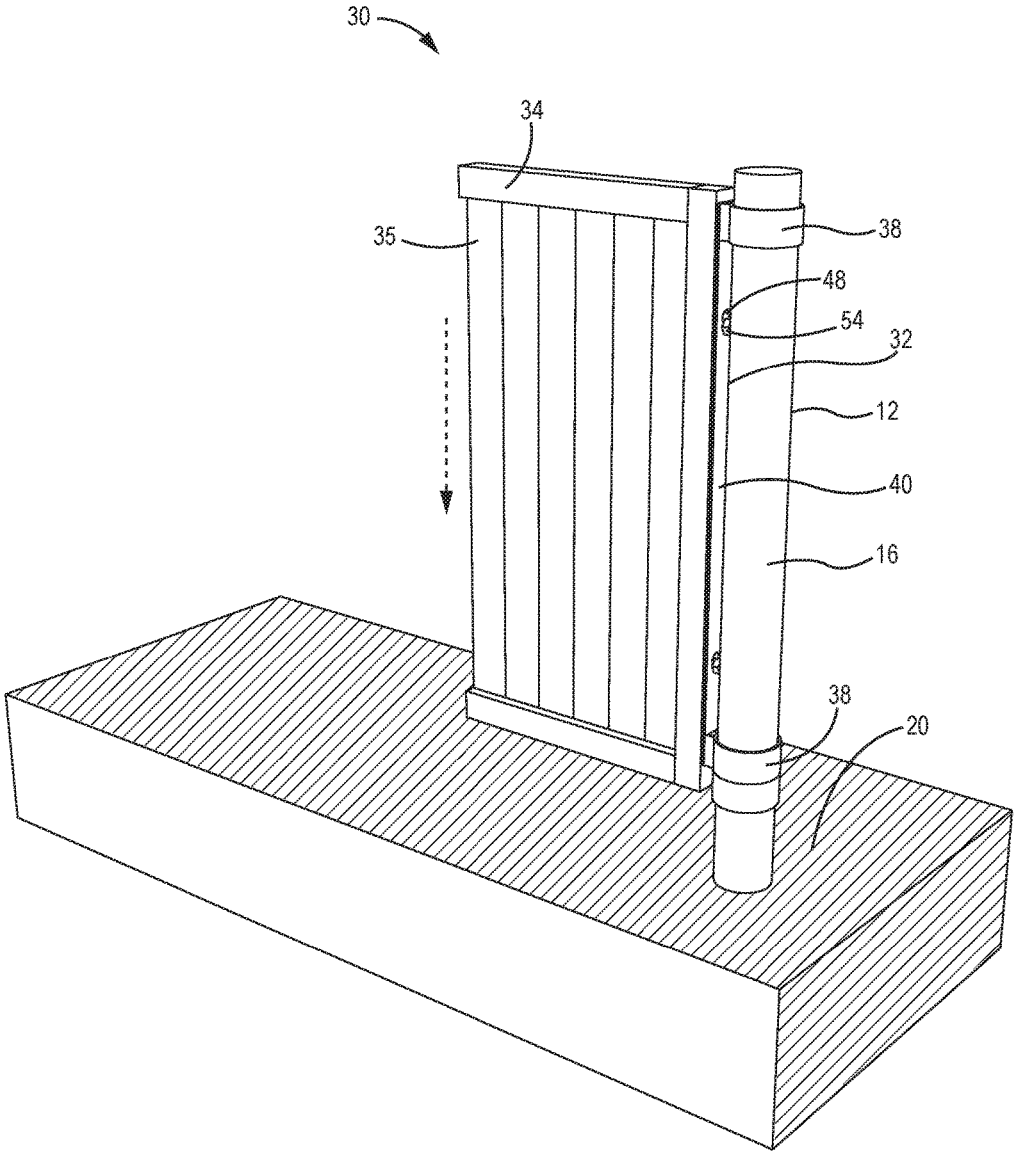

In this regard, FIGS. 4A-4C illustrate a method of installing the breakaway gate system of FIGS. 2A-3 according to an embodiment. As shown in FIG. 4A, the relatively light and compact hinge subassembly 32 may be installed on the vertical hinge post 12, which may be between 6 and 8 feet high or more, prior to attaching the gate subassembly 34. In comparison to lifting the entire unitary gate subassembly 14 of FIG. 1A up and over the vertical hinge post 12, as would be required otherwise, this step is much less labor intensive and is significantly safer. Next, as shown in FIG. 4B, the gate subassembly 34 is positioned to align the standoff members 54 with the wide portions 50 of the keyed apertures 48 of the hinge subassembly 32. The head portions 56 of the standoff members 54 are inserted completely through the wide portions 50 of the keyed apertures 48. Next, as shown in FIG. 4C, the entire gate subassembly 34 is lowered with respect to the hinge subassembly 32, which lowers the stem portions 58 of the standoff members 54 into the respective narrow portions 52 of the keyed apertures 48. The bearing surfaces 64 of the head portions 56 press portions of the vertical mounting plate 40 against the vertical mounting surface 44 of the gate body 35, thereby securely mounting the gate subassembly 34, which may weigh in excess of 125 pounds in this embodiment, and which may weigh as much as 250 pounds or more in some embodiments, to the hinge subassembly 32. To remove the gate sub-assembly 34 from the hinge sub-assembly 32, the process of FIGS. 4A-4C may be reversed.

Figure 5:
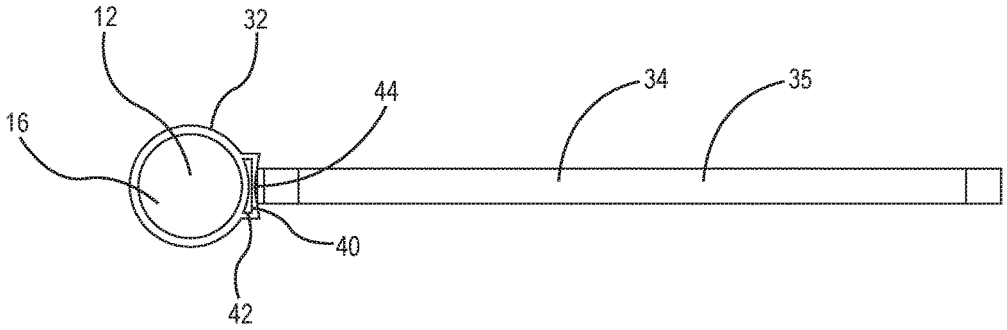
FIG. 5 is a top view of the breakaway gate system of FIGS. 2A-4C according to an embodiment.

When the gate subassembly 34 is mounted on the hinge subassembly 32 in this embodiment, the vertical mounting surface 44 of the gate subassembly 34 is configured to engage the vertical mounting plate 40 parallel to the vertical mounting surface 40, and the gate assembly is able to rotate about the vertical hinge post 12 about an axis of rotation defined by the hinge rings 38. In this regard, FIG. 5 is a top view of the breakaway gate assembly 30 of FIGS. 2A-4C according to an embodiment. As can be seen in FIG. 5, the vertical mounting surface 44 of the gate subassembly 34 is held securely against the vertical mounting plate 40 of the hinge subassembly 32. If excessive force, stress, or strain is applied to the gate body 35, however, the breakaway features 36 are configured to break and allow the gate body 35 to separate from the hinge subassembly 32 without damaging the vertical hinge post 12 or concrete foundation 20.

Figure 6A:
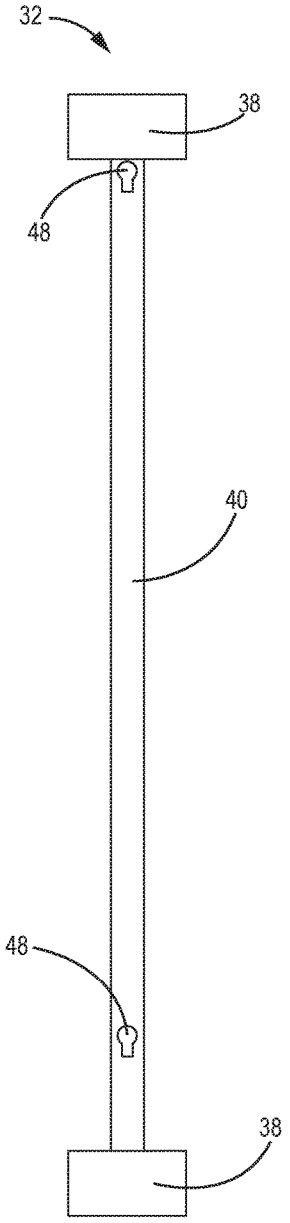
FIGS. 6A-6C are respective rear, side, and front views of the hinge subassembly of the breakaway gate system of FIGS. 2A-5, according to an embodiment.
Figure 6B:
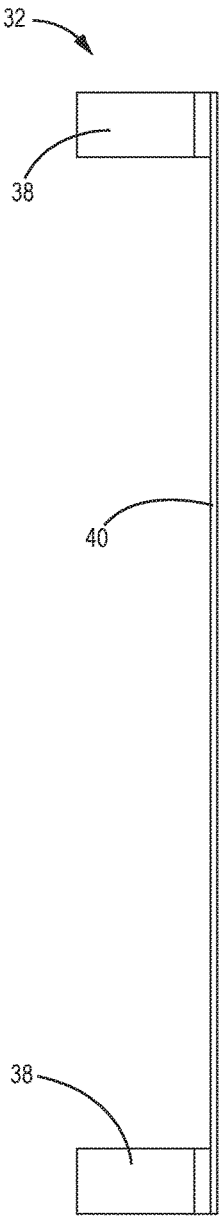
Figure 6C:
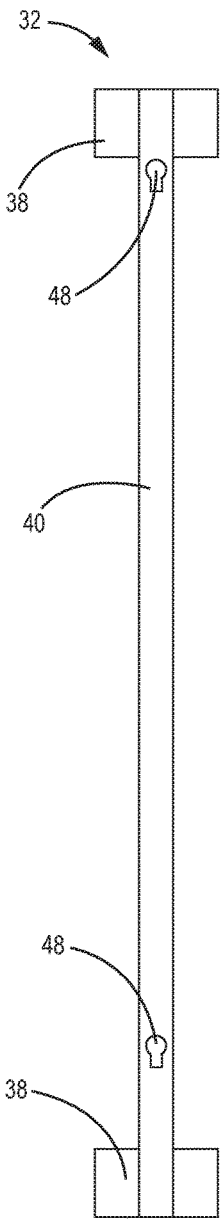

FIGS. 6A-6C are respective rear, side, and front views of the hinge subassembly 32 of the breakaway gate assembly 30 of FIGS. 2A-5, according to an embodiment. In this embodiment, each hinge ring 38 has a 3⁄16" (0.188) wall thickness, and the vertical mounting plate 40 is a 3⁄8"×2" wide plate with a length of 5 feet. It should be understood, however that the length and width of the vertical mounting plate 40 may vary depending on gate frame size required. For example, the length of the vertical mounting plate 40 may be six feet or more, as desired. Two keyed apertures 48 (or more depending on gate height and width) may be cut into the vertical mounting plate 40. The hinge subassembly 32, which may be steel or a steel alloy, such as black steel, for example, can then be coated with a variety of coatings including hot dipped galvanized, conventional paint and/or powder coating to match the finish specified for the gate subassembly 34. It should be understood that other types of suitable materials may be used. It should also be understood that other possible ring wall thicknesses for the hinge rings 38 are contemplated, including, for example: 1⁄8", 3⁄16", 1⁄4", 5⁄16", 3⁄8", 1⁄2", etc. The internal diameter of each hinge ring 38 may also vary based on the vertical hinge post 12 specified for the project, and may be equal to or larger than a diameter of the vertical hinge post 12. For example, typical fence industry post sizes measured in outside diameter include, for example: substantially 1 3⁄8", 1 5⁄8", 2", 2 1⁄2", 3", 4", 6 5⁄8", and 8 5⁄8", etc. The thickness of the vertical mounting plate 40 can also vary to include the following sizes, for example: 1⁄8", 3⁄16", 3⁄4", 5⁄16", 3⁄8," 1⁄2", etc. The width of the vertical mounting plate 40 can also vary, for example from 1" to 9".

Figure 7B:
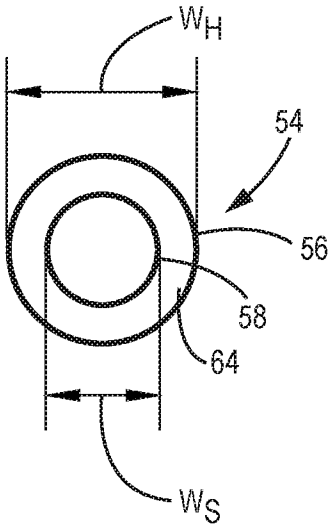
FIGS. 7A and 7B are detailed views of a keyed aperture of the hinge subassembly, and of a standoff member of the gate subassembly of FIGS. 6A-6C, according to an embodiment.
Figure 7A:
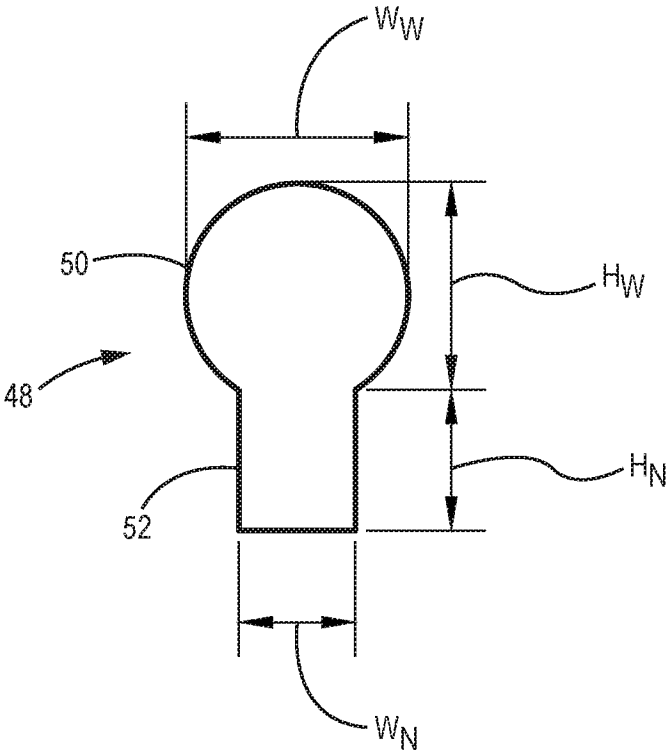

The diameter, shape, and number of the keyed apertures 48 and standoff members 54 can also vary to accommodate different sized gates and gate materials. In this regard, FIGS. 7A and 7B are detailed views of a keyed aperture 48 of the hinge subassembly 32 and a standoff member 54 of the gate subassembly 34 of FIGS. 6A-6C. As can be seen in FIG. 7A, the wide portion 50 of the keyed aperture 48 has a width $W_W$ and a height $H_W$. In this embodiment, the wide portion 50 of the keyed aperture 48 is substantially circular, and $W_W$ and $H_W$ are substantially equal to each other. The narrow portion 52 has a width $W_N$ smaller than the width $W_W$ of the wide portion 50, and has a height $H_N$. In this embodiment, as shown by FIG. 7B, the head portion 56 of the standoff member 54 has a width $W_H$ that is equal to or less than the width $W_W$ of the wide portion 50 of the keyed aperture 48 and that is wider than the width $W_N$ of the narrow portion 52 of the keyed aperture 48, so that the head portion 56 can be passed through the wide portion 50 of the keyed aperture 48 but cannot be removed through the narrow portion 52 of the keyed aperture 48. The stem portion 58 has a width $W_S$ that is equal to or less than the width $W_N$ of the narrow portion 52 of the keyed aperture 48 so that the stem portion 58 can be lowered into the narrow portion 52 of the keyed aperture 48 after the head portion 56 is inserted through the wide portion 50 of the keyed aperture 48, to secure the gate subassembly 34 to the hinge subassembly 32.

Figure 8:
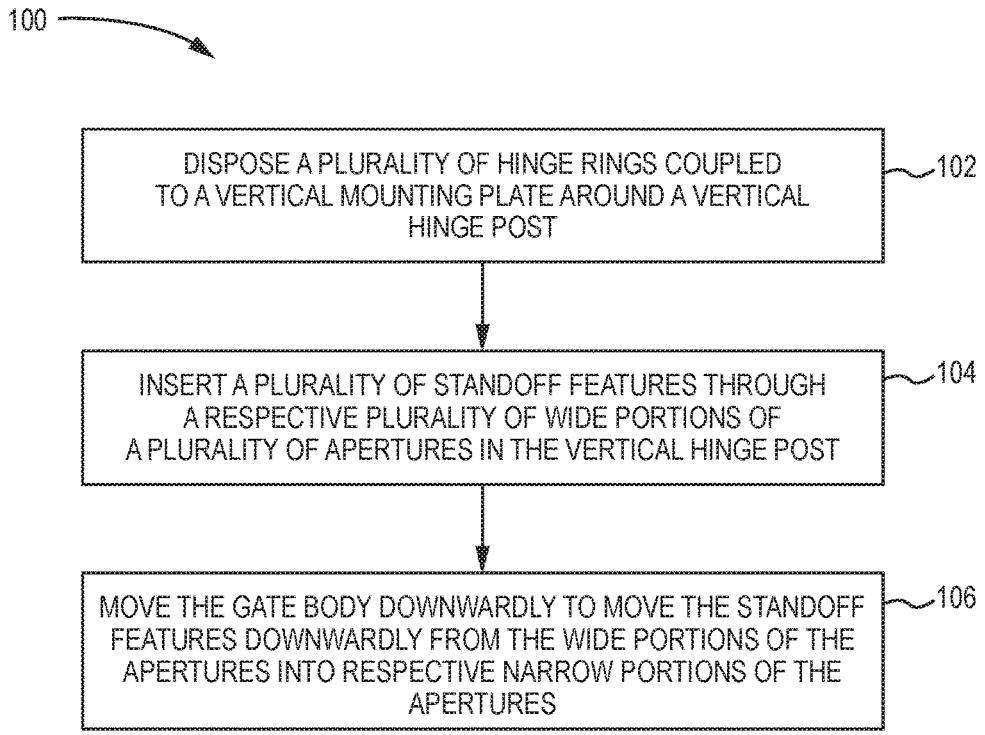
FIG. 8 is a flowchart of a method of assembling a gate subassembly, such as the process of FIGS. 4A-4C, according to an embodiment.

FIG. 8 is a flowchart of a method 100 of assembling a gate subassembly, such as the process of assembling breakaway gate assembly 30 of FIGS. 4A-4C, for example, according to an embodiment. The method 100 comprises disposing a plurality of hinge rings, such as the hinge rings 38 of hinge subassembly 32 described above, around a vertical hinge post (Block 102). In this example, the plurality of hinge rings are coupled to a vertical mounting plate, wherein the vertical mounting plate is rotatable with respect to the vertical hinge post. The method 100 further comprises inserting a plurality of standoff features extending from a gate body of a gate subassembly, such as the gate subassembly 34, through a respective plurality of wide portions of a plurality of apertures in the vertical hinge post (Block 104). The gate subassembly contacts a vertical mounting surface of the gate body with a first plate surface of the vertical mounting plate. The method 100 further comprises moving the gate body downwardly with respect to the vertical mounting plate to move the standoff features downwardly from the wide portions of the plurality of apertures into respective narrow portions of the plurality of apertures (Block 106).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications, combinations, sub-combinations, and variations of the disclosed embodiments incorporating the spirit and substance of the invention may occur to persons skilled in the art, the invention should be construed to include everything within the scope of the appended claims and their equivalents.

What is claimed is:

1. A breakaway gate assembly comprising:

a vertical hinge post having a first diameter;

a gate subassembly comprising:

a gate body comprising a vertical mounting surface;

a plurality of standoff features coupled to the gate body, each of the plurality of standoff features comprising:

a stem portion extending horizontally away from the vertical mounting surface, the stem portion having a first horizontal width; and a head portion coupled to a distal end of the stem portion, the head portion having a second horizontal width greater than the first horizontal width, the head portion having a bearing surface facing the vertical mounting surface;

a hinge subassembly configured to support the gate subassembly, the hinge subassembly comprising:

a vertical mounting plate comprising a first plate surface and a second plate surface opposite the first plate surface, the vertical mounting plate forming a plurality of apertures configured to receive and secure the respective plurality of standoff features, each of the plurality of apertures comprising:

a wide portion having a third horizontal width larger than the first horizontal width; and a narrow portion having a fourth horizontal width smaller than the third horizontal width and equal to or greater than the second horizontal width, the narrow portion configured to receive and retain a respective stem portion to position a portion of the vertical mounting plate between the vertical mounting surface and a respective bearing surface; and a plurality of hinge rings coupled to the first plate surface, the plurality of hinge rings rotatably disposed around the vertical hinge post, the plurality of hinge rings having an internal diameter larger than the first diameter.

2. The breakaway gate assembly of claim 1, wherein each of the plurality of standoff features comprises a threaded fastener disposed in a gate aperture of the gate body.

3. The breakaway gate assembly of claim 2, wherein each of the plurality of standoff features comprises a bolt disposed through the gate aperture and at least one nut retaining the bolt in the gate aperture.

4. The breakaway gate assembly of claim 1, wherein the plurality of standoff features are configured to withstand a first gravitational force having a first magnitude applied to the gate body when the plurality of standoff features are received and secured by the plurality of apertures of the vertical mounting plate.

5. The breakaway gate assembly of claim 4, wherein the plurality of standoff features are configured to fail in response to a second force having a second magnitude greater than the first magnitude when the plurality of standoff features are received and secured by the plurality of apertures of the vertical mounting plate.

6. The breakaway gate assembly of claim 1, wherein each of the plurality of standoff features comprises a weakened portion configured to:

withstand a first gravitational force having a first magnitude applied to the gate body when each of the plurality of standoff features is received and secured by the plurality of apertures of the vertical mounting plate, and fail in response to a second force having a second magnitude greater than the first magnitude when the plurality of standoff features is received and secured by the plurality of apertures of the vertical mounting plate.

7. The breakaway gate assembly of claim 1, wherein the vertical mounting surface of the gate subassembly is configured to engage the vertical mounting plate parallel to the vertical mounting surface in response to the hinge subassembly supporting the gate subassembly.

8. The breakaway gate assembly of claim 1, wherein the plurality of hinge rings defines an axis of rotation substantially parallel to the first plate surface and the second plate surface of the vertical mounting plate of the hinge subassembly.

9. The breakaway gate assembly of claim 8, wherein the plurality of hinge rings are welded to the first plate surface of the vertical mounting plate.

10. The breakaway gate assembly of claim 1, wherein the hinge subassembly and the standoff features are formed from one of: steel and a steel alloy.

11. The breakaway gate assembly of claim 1, wherein the first diameter of the hinge post is in a range between substantially one and three eighths inches (1⅜") and substantially eight and five eighths inches (8⅝") and the internal diameter of each of the plurality of hinge rings is in a range between substantially one and three eighths inches (1⅜") and substantially eight and five eighths inches (8⅝").

12. The breakaway gate assembly of claim 1, wherein the gate body has a weight greater than substantially 125 pounds.

* * * * *